US011828544B2

(12) United States Patent
Shimano et al.

(10) Patent No.: US 11,828,544 B2
(45) Date of Patent: Nov. 28, 2023

(54) HEAT EXCHANGER

(71) Applicant: FUJITSU GENERAL LIMITED, Kanagawa (JP)

(72) Inventors: Daiki Shimano, Kanagawa (JP); Ryo Takaoka, Kanagawa (JP); Masatoshi Watanabe, Kanagawa (JP); Yoshinari Maema, Kanagawa (JP); Shohei Nakata, Kanagawa (JP); Kotaro Oka, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 214 days.

(21) Appl. No.: 17/435,251

(22) PCT Filed: Mar. 25, 2020

(86) PCT No.: PCT/JP2020/013238
§ 371 (c)(1),
(2) Date: Aug. 31, 2021

(87) PCT Pub. No.: WO2020/196592
PCT Pub. Date: Oct. 1, 2020

(65) Prior Publication Data

US 2022/0128319 A1 Apr. 28, 2022

(30) Foreign Application Priority Data

Mar. 28, 2019 (JP) ..... 2019-062121

(51) Int. Cl.
*F28F 9/04* (2006.01)
*F28F 1/12* (2006.01)
*F28F 1/02* (2006.01)

(52) U.S. Cl.
CPC . *F28F 1/12* (2013.01); *F28F 1/02* (2013.01)

(58) Field of Classification Search
CPC ..... F28F 1/12; F28F 1/02
(Continued)

(56) References Cited

U.S. PATENT DOCUMENTS

2014/0116667 A1 5/2014 Choi et al.
2017/0248370 A1 8/2017 Nakamura et al.
(Continued)

FOREIGN PATENT DOCUMENTS

CN 103791659 A 5/2014
CN 106716042 A 5/2017
(Continued)

OTHER PUBLICATIONS

Nov. 22, 2022, Chinese Office Action issued for related CN Application No. 202080019290.8.
(Continued)

*Primary Examiner* — Davis D Hwu
(74) *Attorney, Agent, or Firm* — Paratus Law Group, PLLC

(57) ABSTRACT

A heat exchanger includes: a plurality of flat tubes that are stacked in a direction perpendicular to a refrigerant flow direction, and a plurality of fins that have a first flat tube insertion portion into which a first flat tube among the plurality of flat tubes is inserted, and a second flat tube insertion portion into which a second flat tube adjacent to the first flat tube is inserted. A first fin has, formed on the inner periphery of the first flat tube insertion portion, a cut and raised piece for spacing a fin pitch between the first fin and an adjacent second fin. The cut and raised piece has a raised portion of the same length as the fin pitch, and a folded portion that is folded back at the tip of the raised portion and that is in contact with the second fin.

4 Claims, 8 Drawing Sheets

(58) Field of Classification Search
USPC ..... 165/178
See application file for complete search history.

(56) References Cited

U.S. PATENT DOCUMENTS

| | | | |
|---|---|---|---|
| 2018/0106563 | A1 | 4/2018 | Nakamura et al. |
| 2018/0320978 | A1 | 11/2018 | Nakamura et al. |
| 2019/0137193 | A1 | 5/2019 | Yoshioka et al. |

FOREIGN PATENT DOCUMENTS

| | | | | |
|---|---|---|---|---|
| CN | 109073333 | A | | 12/2018 |
| CN | 109186308 | A | | 1/2019 |
| EP | 2725311 | A2 | | 4/2014 |
| EP | 3447430 | A1 | | 2/2019 |
| JP | S48-015660 | U | | 2/1973 |
| JP | 2005-127595 | A | | 5/2005 |
| JP | 2017-198440 | A | | 11/2017 |
| JP | WO2017208493 | A1 | * | 12/2017 |
| KR | 10-2014-0055945 | A | | 5/2014 |
| WO | WO 2016/038652 | A1 | | 3/2016 |
| WO | WO 2016/194088 | A1 | | 12/2016 |

OTHER PUBLICATIONS

Nov. 2, 2022, European Search Report issued for related EP Application No. 20778582.5.

* cited by examiner

HEAT EXCHANGER

CROSS REFERENCE TO PRIOR APPLICATION

This application is a National Stage Patent Application of PCT International Patent Application No. PCT/JP2020/013238 (filed on Mar. 25, 2020) under 35 U.S.C. § 371, which claims priority to Japanese Patent Application No. 2019-062121 (filed on Mar. 28, 2019), which are all hereby incorporated by reference in their entirety.

FIELD

The present invention relates to a heat exchanger.

BACKGROUND

Conventionally, a heat exchanger is known that has a structure in which the both ends of a flat tube (heat transfer tube) having a plurality of flow path holes therein is connected to a pair of headers, and the diversion of refrigerant to a plurality of flat tubes takes place in the headers. The plurality of flat tubes are stacked in a direction perpendicular to the refrigerant flow direction. Further, a plurality of fins are arranged between the pair of headers connected to the both ends of the flat tubes, and the flat tubes are connected to the plurality of fins. In this heat exchanger, heat is exchanged by the plurality of fins, between the refrigerant that flows through the flow path holes inside the flat tubes, and air that passes between the plurality of fins.

For example, as illustrated in FIG. 5, a fin 111A of a heat exchanger 5A has a flat tube insertion portion 113A which is obtained by cutting out part of a ventilation portion 112A. A flat tube 11 is inserted into the flat tube insertion portion 113A of the fin 111A (in the heat exchanger 5A, a plurality of fins 111A are arranged in a direction orthogonal to the paper of FIG. 5). A plurality of flow path holes 10A through which refrigerant flows, are provided inside the flat tube 11.

Here, a structure is known in which, in order to secure a fin pitch P1 between adjacent fins 111A, as illustrated in FIG. 6, part of the fins 111A is used as a cut and raised piece 114A, and the fin pitch P1 is secured by bringing the cut and raised piece 114A into contact with an adjacent fin 111A. The cut and raised piece 114A has a raised portion 115A which is raised from the fin 111A, and a folded portion 116A which is obtained by folding back the tip of the raised portion 115A. The portion of the fin 111A that is cut out over length W1 by forming the cut and raised piece 114A, is called the cutout remainder portion C1.

By way of an example, the cut and raised piece 114A is formed in the ventilation portion 112A of the fin 111A as illustrated in FIG. 7, in the area corresponding to the cutout remainder portion C1, that is, in the position for forming the cut and raised piece 114A. However, the case of this example is undesirable in terms of ventilation resistance of the air that circulates between the fins 111A and the drainage of condensate that adheres to the surface of the fins 111A. In contrast, there is an example in which the cut and raised piece 114A is formed in the flat tube insertion portion 113A of the fin 111A, as illustrated in FIG. 8. In the case of this example, the cut and raised piece 114A is disposed in a position of contact with the flat tube 11, along the longitudinal direction of the flat tube 11, so as to not interfere with the ventilation between the fins 111A, and not reduce the drainage of condensate (see, for example, Patent Literature 1). Normally, the flat tube insertion portion 113A is formed by cutting out part of the fin 111A through pressing or the like (see FIG. 9, the black areas of FIG. 9 are removed). However, in Patent Literature 1, at least part of the flat tube insertion portion 113A remains as a cutout remainder portion C1 instead of being removed, and the cutout remainder portion C1 is bent in the direction perpendicular to the ventilation portion 112A to be used as the cut and raised piece 114A (see FIG. 8).

However, in the structure of Patent Literature 1, the cutout remainder portion C1, that is, the length of the cut and raised piece 114A that is bent and raised relative to the ventilation portion 112A, is limited to the width range of the flat tube insertion portion 113A, which corresponds to the thickness of the flat tube 11. Therefore, in Patent Literature 1, when the thickness of the flat tube 11 is smaller than the demanded fin pitch P1, the cutout remainder portion C1 is not adequately securable and hence there has been the problem that the cut and raised piece 114A is not reachable to the adjacent fin 111A, and the fin pitch P1 between adjacent fins 111A is not properly securable.

CITATION LIST

Patent Literature

Patent Literature 1: Japanese Patent Laid-open Publication No. 2017-198440.

SUMMARY

Technical Problem

An object of the present invention, which was conceived in view of the foregoing problem, is to provide a heat exchanger in which a desired fin pitch can be secured irrespective of the thickness of a flat tube.

Solution to Problem

According to an aspect of the embodiments, a heat exchanger includes: a plurality of flat tubes that are stacked in a direction perpendicular to a refrigerant flow direction; and a plurality of fins that have a first flat tube insertion portion into which a first flat tube among the plurality of flat tubes is inserted, and a second flat tube insertion portion into which a second flat tube adjacent to the first flat tube is inserted, wherein a first fin among the plurality of fins has, formed on the inner periphery of the first flat tube insertion portion, a cut and raised piece for spacing a fin pitch between the first fin and an adjacent second fin, and wherein the cut and raised piece has a raised portion of the same length as the fin pitch, and a folded portion that is folded back at the tip of the raised portion and that is in contact with the second fin.

Advantageous Effects of Invention

According to the present invention, a desired fin pitch can be secured irrespective of the thickness of a flat tube.

DESCRIPTION OF EMBODIMENTS

Embodiment

A mode for carrying out the present invention (referred to as the "embodiment" hereinbelow) will be described in detail hereinbelow on the basis of the accompanying drawings. Note that the same reference numbers are assigned to the same elements throughout the description of the embodiment.

Overall Configuration of Air Conditioner

Figure 1:
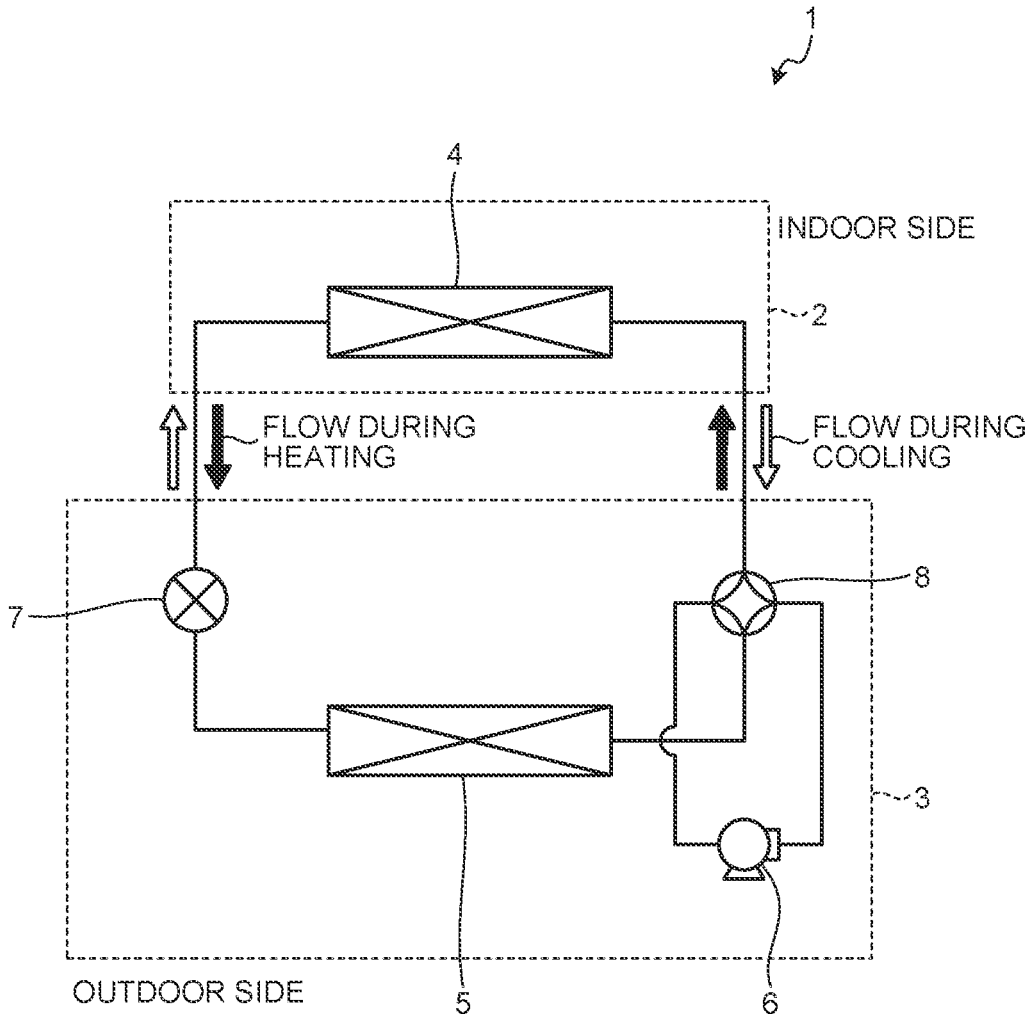
FIG. 1 is a diagram illustrating a configuration of an air conditioner to which a heat exchanger according to an embodiment is applied.

FIG. 1 illustrates a configuration of an air conditioner 1 to which a heat exchanger 5 according to the embodiment of the present invention is applied. As illustrated in FIG. 1, the air conditioner 1 is provided with an indoor unit 2 and an outdoor unit 3. The indoor unit 2 is provided with an indoor heat exchanger 4. The outdoor unit 3 is provided with a compressor 6, an expansion valve 7, and a four-way valve 8, and the like, in addition to the outdoor heat exchanger 5.

During a heating operation, the high-temperature, high-pressure gas refrigerant discharged from the compressor 6 of the outdoor unit 3, flows into the indoor heat exchanger 4 via the four-way valve 8. Refrigerant flows in the direction of the black arrow in FIG. 1. During the heating operation, the indoor heat exchanger 4 functions as a condenser, and the refrigerant, which exchanges heat with the air, condenses and liquefies. Thereafter, the high-pressure liquid refrigerant is depressurized by passing through the expansion valve 7 of the outdoor unit 3, becomes a low-temperature, low-pressure gas-liquid two-phase refrigerant, and flows into the outdoor heat exchanger 5. The outdoor heat exchanger 5 functions as an evaporator, and the refrigerant, which exchanges heat with the outside air, is gasified. The low-pressure gas refrigerant is then drawn into the compressor 6 via the four-way valve 8.

During a cooling operation, the high-temperature, high-pressure gas refrigerant discharged from the compressor 6 of the outdoor unit 3, flows into the outdoor heat exchanger 5 via the four-way valve 8. The refrigerant flows in the direction of the white arrow in FIG. 1. During the cooling operation, the outdoor heat exchanger 5 functions as a condenser, and the refrigerant, which exchanges heat with the outside air, condenses and liquefies. Thereafter, the high-pressure liquid refrigerant is depressurized by passing through the expansion valve 7 of the outdoor unit 3, becomes a low-temperature, low-pressure gas-liquid two-phase refrigerant, and flows into the indoor heat exchanger 4. The indoor heat exchanger 4 functions as an evaporator, and the refrigerant, which exchanges heat with the air, is gasified. The low-pressure gas refrigerant is then drawn into the compressor 6 via the four-way valve 8.

Heat Exchanger

Although the heat exchanger according to the present embodiment can be applied to the indoor heat exchanger 4 and the outdoor heat exchanger 5, the following description assumes that the heat exchanger according to the embodiment, is applied to the heat exchanger 5 of the outdoor unit 3, which functions as an evaporator during a heating operation. Note that the heat exchanger 5 of the outdoor unit 3 may be used as a flat type as illustrated in FIG. 1, or may be used in FIG. 1 by being formed in an L-shape. Normally, the L-shaped heat exchanger 5 is obtained by bending the heat exchanger 5 formed with a flat shape. The specific manufacturing process for manufacturing the L-shaped heat exchanger 5, involves an assembly process of assembling the flat-type heat exchanger 5 using members that are surface-coated with a brazing material, a brazing process of placing the assembled flat-type heat exchanger 5 in a furnace and brazing same, and a bending process of bending the brazed flat-type heat exchanger 5 into an L shape. The heat exchanger of the present invention is described hereinbelow as a flat-type heat exchanger 5.

Figure 2A:
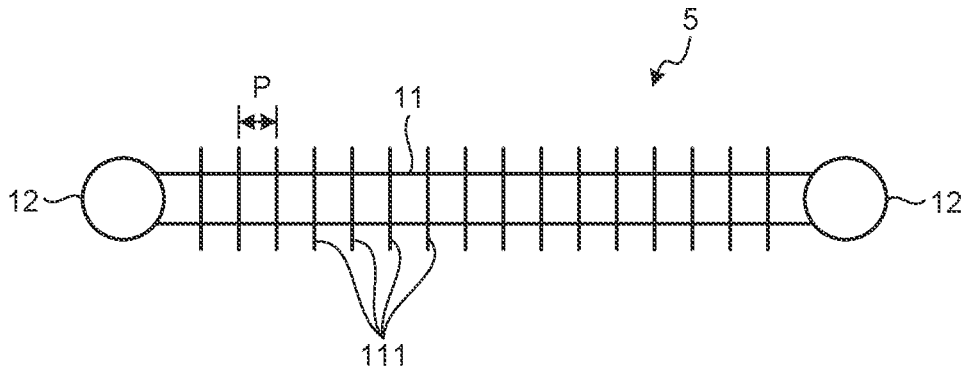
FIG. 2A is a plan view to illustrate the heat exchanger according to the embodiment.
Figure 2B:
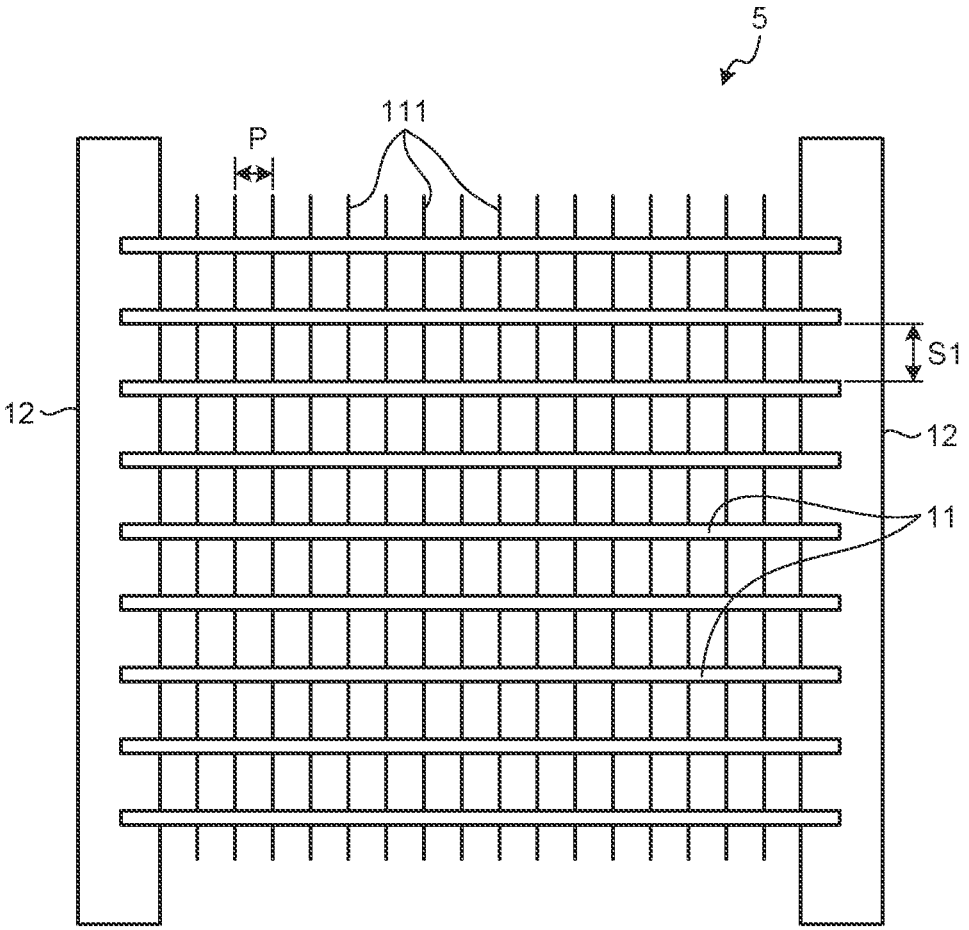
FIG. 2B is a front elevation view to illustrate the heat exchanger according to the embodiment.

FIG. 2A is a plan view to illustrate the heat exchanger 5 according to the embodiment. FIG. 2B is a front elevation view to illustrate the heat exchanger 5 according to the embodiment. As illustrated in FIGS. 2A and 2B, the flat tube 11 has a flat shape with respect to the up-down direction, and is provided along the direction in which the refrigerant flows between the pair of headers 12 (along the longitudinal direction of the flat tube 11), and air is circulated along the lateral direction of the flat tube 11. Inside the flat tube 11, a plurality of flow path holes 10A, through which the refrigerant flows along the longitudinal direction of the flat tube 11, are formed in line with the air circulation direction (the lateral direction of the flat tube 11). The heat exchanger 5 has a plurality of flat tubes 11 arranged in the up-down direction (perpendicular to the flow direction of the refrigerant) so that, among the sides of the flat tubes 11, the sides that are wider along the longitudinal direction of the flat tubes 11 are opposite each other; a pair of left and right headers 12 connected to the both ends of the flat tubes 11; and a plurality of fins 111 arranged in the direction intersecting the flat tubes 11 and joined to each of the flat tubes 11. With regard to the plurality of flat tubes 11, of two flat tubes 11 which are adjacent to each other in the up-down direction, the upper flat tube 11 in the drawings may be referred to as a first flat tube 11A, and the lower flat tube 11 in the drawings may be referred to as a second flat tube 11B. In addition to these flat tubes, the heat exchanger 5 has refrigerant piping connected to the header 12, which connects to other elements of the air conditioner 1 and through which the refrigerant flows (not illustrated).

The flat tubes 11 are arranged in parallel in the up-down direction with a spacing S1 for air to pass through, and the both ends of the flat tubes 11 are connected to the pair of headers 12. Specifically, in FIG. 2B, a plurality of flat tubes 11 along the left-right direction are arranged in the up-down direction with the predetermined spacing S1 through which air is circulated, and the both ends of each flat tube 11 are connected to the headers 12.

The headers 12 are formed in a cylindrical shape, and a refrigerant flow path (not illustrated) is formed inside the headers 12 to divert the refrigerant, supplied to the heat exchanger 5, into each of the plurality of flat tubes 11, or to merge the refrigerant flowing out of each of the plurality of flat tubes 11.

The fins 111 are formed in the shape of flat plates when viewed from the front of the heat exchanger 5, and are arranged stacked in the longitudinal direction of the flat tubes 11 so as to intersect the flat tubes 11. The plurality of flat tubes 11 are arranged in parallel with a gap S1 for air to pass through. A plurality of fins 111 along the up-down direction are arranged at a predetermined fin pitch P with respect to the longitudinal direction of the flat tubes 11 (the left-right direction in FIG. 2B).

Fin Main Parts

Figure 3:
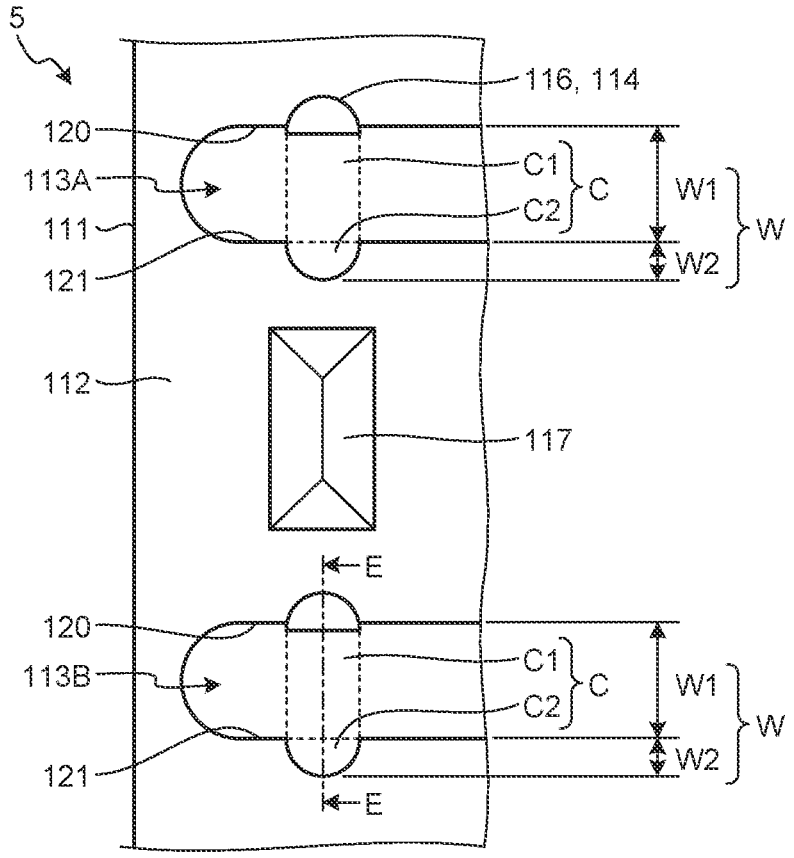
FIG. 3 is a lateral view to illustrate a heat exchanger fin according to the embodiment.
Figure 4:
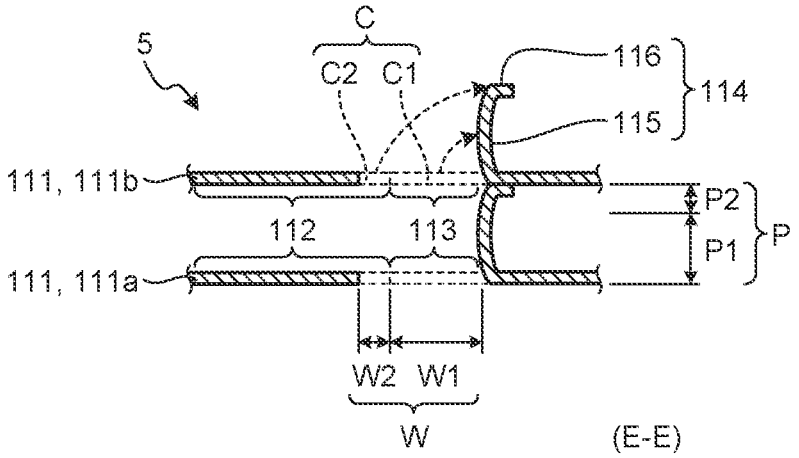
FIG. 4 is a cross-sectional view along E-E in FIG. 3 illustrating the heat exchanger fin according to the embodiment.
Figure 5:
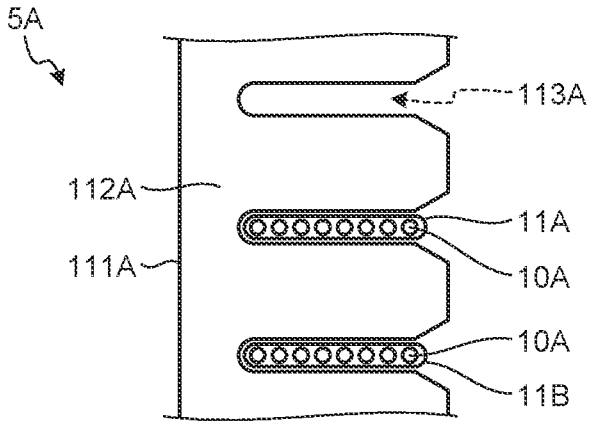
FIG. 5 is a diagram illustrating a flat tube insertion portion of the fin, in a heat exchanger of related art.

Next, the main parts of the fins 111 of the heat exchanger 5 according to the present embodiment, will be described using FIGS. 3 and 4. Note that FIGS. 3 and 4 provide an enlarged view of the area around flat tube insertion portions 113 of the fin 111 (described subsequently), and the flat tube 11 is not illustrated. A cut and raised piece 114 of this example has a raised portion 115 and a folded portion 116 obtained by folding back the tip of the raised portion 115.

As illustrated in FIG. 3, the fin 111 is provided with a ventilation portion 112, a plurality of flat tube insertion portions 113, and a plurality of cut and raised pieces 114. The ventilation portion 112 is provided between the flat tube insertion portions 113. The flat tube insertion portion 113 is formed by cutting out a part of the fin 111 through pressing or the like, except for the portion that forms part of the cut and raised piece 114 (the cutout remainder portion C1). The cut and raised piece 114 is configured from a portion corresponding to the cutout remainder portion C1 of the fin 111, and a portion corresponding to the cutout portion C2 composed of part on the ventilation portion 112 side of the inner periphery opposite to the inner periphery of the flat tube insertion portion 113 where the cut and raised piece 114 is raised. The cutout portion C2 is a through portion that is contiguous with the flat tube insertion portion 113. For the plurality of flat tube insertion portions 113, of the two flat tube insertion portions 113 that are adjacent to each other in the up-down direction, the upper flat tube insertion portion 113 in FIG. 3 may be referred to as the first flat tube insertion portion 113A (corresponding to the first flat tube 11A), and a lower flat tube insertion portion 113 in FIG. 3 may be referred to as a second flat tube insertion portion 113B (corresponding to the second flat tube 11B).

The cut and raised piece 114 is bent at a first side 120 (the upper inner periphery in FIG. 3) of the flat tube insertion portion 113. The region C that constitutes the entire cut and raised piece 114 refers to the portion of the fin 111 that corresponds to the cutout remainder portion C1 of the flat tube insertion portion 113, and to the portion that corresponds to the cutout portion C2 formed by cutting out part of the ventilation portion 112 on a second side 121 (the lower inner periphery in FIG. 3) opposite the first side 120. The length of the raised portion 115 is the length in the direction in which the raised portion 115 rises from the inner periphery of the flat tube insertion portion 113, and is formed with the same length as the fin pitch P (see FIG. 4). The length of the cutout remainder portion C1 is length W1 from the first side 120 to the second side 121, and the length of the cutout portion C2 is length W2 up to the contour which is the greatest distance (the lower end of the arc-shaped cutout portion C2) from the second side 121. In other words, the combined length of the raised portion 115 and the folded portion 116, which constitute the whole of the cut and raised piece 114, is length W, which is obtained by adding length W2 to length W1.

Note that, in FIG. 3, the cut and raised piece 114 is provided on the first side 120, which is the upper inner periphery in FIG. 3, of the flat tube insertion portion 113, but may of course also be provided on the second side 121, which is the lower inner periphery in FIG. 3. In other words, the cut and raised piece 114 may also be formed by being raised from the second side 121 of the flat tube insertion portion 113.

Figure 6:
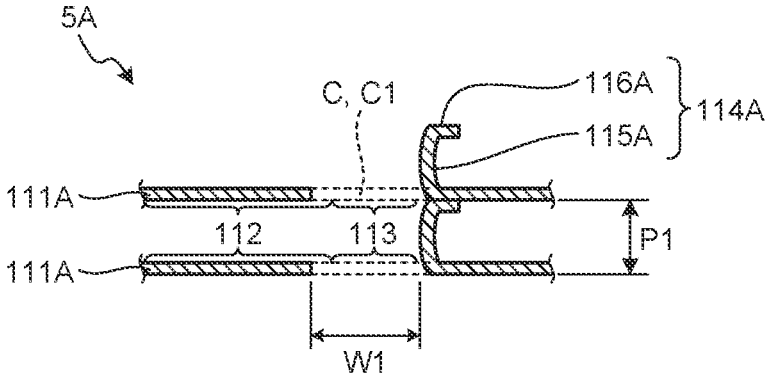
FIG. 6 is a diagram illustrating a cut and raised portion of the fin, in a heat exchanger of related art.
Figure 7:
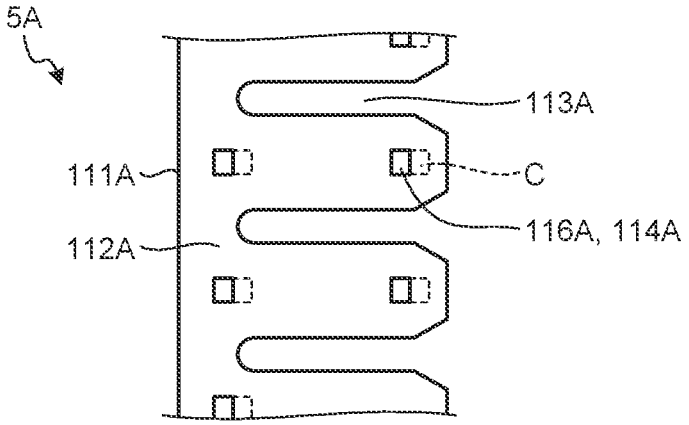
FIG. 7 is a diagram illustrating an example in which a cut and raised portion of a fin is provided in a ventilation portion of the fin, in a heat exchanger of related art.
Figure 8:
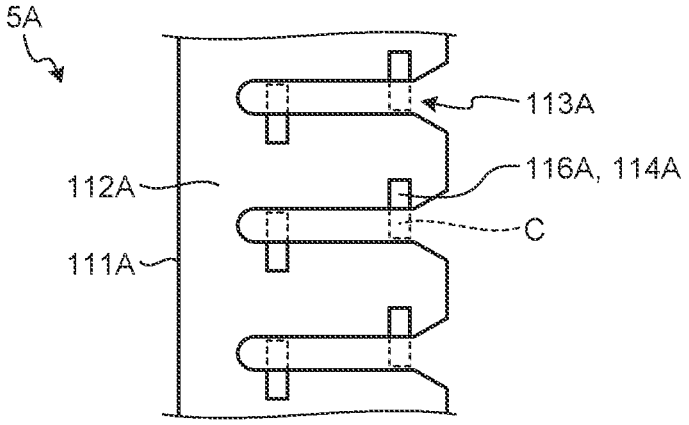
FIG. 8 is a diagram illustrating an example in which a cut and raised portion of a fin is provided in the flat tube insertion portion, in a heat exchanger of related art.
Figure 9:
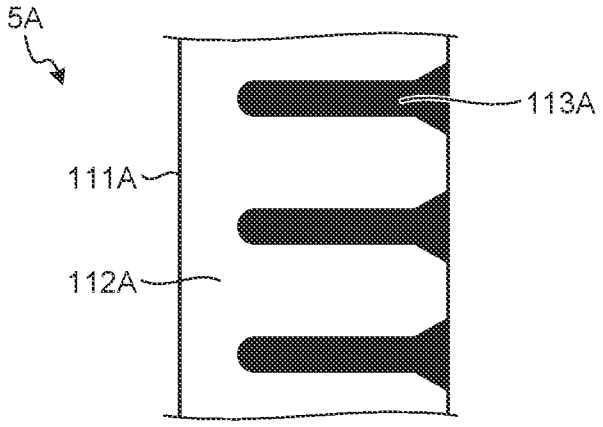
FIG. 9 is a diagram illustrating a cutout portion of the flat tube insertion portion, in a heat exchanger of related art.

The cross section of the cut and raised piece 114, in a state where the cut and raised piece has been cut and bent from the fin 111, is illustrated in FIG. 4. FIG. 4 illustrates the relationship between the fin pitch P between adjacent fins 111 and the cut and raised piece 114. The reference sign indicating the upper fin 111 in FIG. 4 is similarly applied to the lower fin 111 in FIG. 4. Note that, in FIG. 4, which illustrates the structure according to the present embodiment, the cutout portion C2 is expediently illustrated as part of the ventilation portion 112 for the sake of comparison with FIG. 6, which illustrates a conventional structure. As illustrated in FIG. 4, in a first fin 111*a* (the lower fin 111 in FIG. 4), a cut and raised piece 114, which has a portion corresponding to the cutout remainder portion C1 of the flat tube insertion portion 113 and a portion corresponding to the cutout portion C2 on the ventilation portion 112 side of the flat tube insertion portion 113, is formed by bending the first side 120 of the flat tube insertion portion 113 (the inner periphery on the right side in FIG. 4).

In the cut and raised piece 114A (see FIG. 6) of the foregoing conventional structure, the region C of the fin 111A, which constitutes the cut and raised piece 114A, coincides with the portion (length W1) corresponding to the cutout remainder portion C1 of the flat tube insertion portion 113A. Hence, the fin pitch P1 in the conventional structure is limited to the area of the portion (length W1) corresponding to the cutout remainder portion C1. Therefore, the portion (length W1) corresponding to this cutout remainder portion C1 substantially corresponds to the thickness dimension of the flat tube 11. Hence, if the desired fin pitch P1 is larger than the thickness dimension of the flat tube 11, the length of the cut and raised piece 114A will be lacking by an amount equivalent to the portion corresponding to the cutout remainder portion C1 (length W1).

In contrast, as illustrated in FIG. 4, the cut and raised piece 114 according to the present embodiment has length W1, which is obtained by adding a portion (length W2) corresponding to the cutout portion C2 provided on the second side 121, which is part on the ventilation portion 112 side, to the portion (length W1) wherein the region C of the first fin 111*a* constituting the cut and raised piece 114 corresponds to the cutout remainder portion C1 of the flat tube insertion portion 113. Therefore, even when the desired fin pitch P is larger than the dimension of the thickness of the flat tube 11, the desired fin pitch P can be secured because it is possible, when the cut and raised piece 114 is cut and raised, to add a distance P2 to the fin pitch P1 corresponding to the thickness of the flat tube 11.

Here, the cut and raised piece 114 does not necessarily have to be provided with the folded portion 116, but it is preferable that the cut and raised piece 114 make surface contact with an adjacent second fin 111*b* via the folded portion 116 in order to prevent the cut and raised piece 114 from being crushed and to secure the fin pitch P more reliably.

Note that FIGS. 3 and 4 do not indicate that the entire length of the portion corresponding to the cutout portion C2 (length W2) corresponds to the folded portion 116. The length W2 of the portion corresponding to the cutout portion C2 may be set appropriately depending on the desired fin pitch P and the portion corresponding to the cutout remainder portion C1 of the flat tube insertion portion 113 (length W1), that is, the thickness of the flat tube 11, and the portion corresponding to the cutout portion C2 may constitute part of the raised portion 115 and the folded portion 116 according to the desired fin pitch P.

Furthermore, the portion corresponding to the cutout remainder portion C1 and the portion corresponding to the cutout portion C2, are not limited to the shapes illustrated, and may be other shapes.

A fin reinforcement portion 137 will be described with reference to FIG. 3. The fin 111 may be further provided with a fin reinforcement portion 117, as illustrated in FIG. 3, when the stiffness due to same being reduced by the formation of the cutout portion C2 needs to be enhanced.

The fin reinforcement portion 117 is provided in the ventilation portion 112 on the second side 121 of the flat tube insertion portion 113, near the cutout portion C2 which is part of the region C cut out as part of the cut and raised piece 114. The fin reinforcement portion 117 can be, for example, any of a bulging structure with a convex arc shape, a protruding structure with a convex shape with corners, or a corrugated structure obtained by placing a plurality of such structures in a row. FIG. 3 illustrates a roof-type protruding structure, but does not limit the shape of the fin reinforcement portion. The fins 111 may be provided with a bulging structure, a protruding structure or a corrugated structure, or the like, to improve heat transfer, and these structures may also be used as the fin reinforcement portion 117.

Advantageous Effects of the Present Embodiment

In the present embodiment, as described above, the cut and raised piece 114 is configured from a portion corresponding to the cutout remainder portion C1 that is cut and raised by being bent on the first side 120 of the flat tube insertion portion 113, and from a portion corresponding to the cutout portion C2, which is part of the ventilation portion 112 on the second side 121 opposite the first side 120 and which is cut and raised integrally with the portion corresponding to the cutout remainder portion C1. Thus, a cut and raised piece 114 larger than the thickness of the flat tube 11 can be formed on the inner periphery of the flat tube insertion portion 113, irrespective of the thickness of the flat tube 11, even when the desired fin pitch P is larger than the thickness of the flat tube 11. It is thus possible to provide a heat exchanger 5 capable of securing a desired fin pitch P that is larger than the thickness of the flat tube 11.

Variation

Although a preferred embodiment of the present invention has been described in detail hereinabove, the present invention is not limited to the foregoing embodiment, and various variations and modifications are possible within the scope of the gist of the present invention as disclosed in the patent claims. Although several variations are described hereinbelow, variations are not limited to such variations, and these variations can be combined within a reasonable scope.

Figure 10:
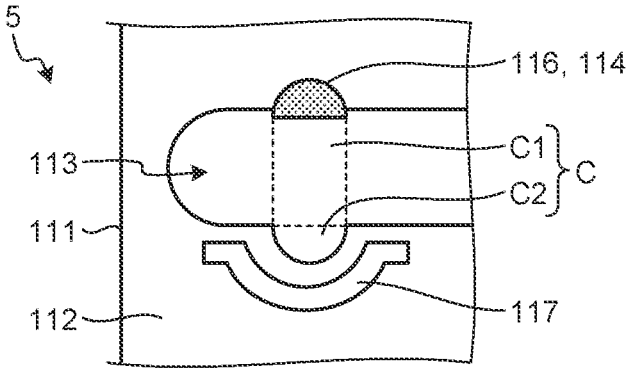
FIG. 10 is a diagram illustrating one variation of a fin reinforcement portion of the heat exchanger fin according to the embodiment.
Figure 11:
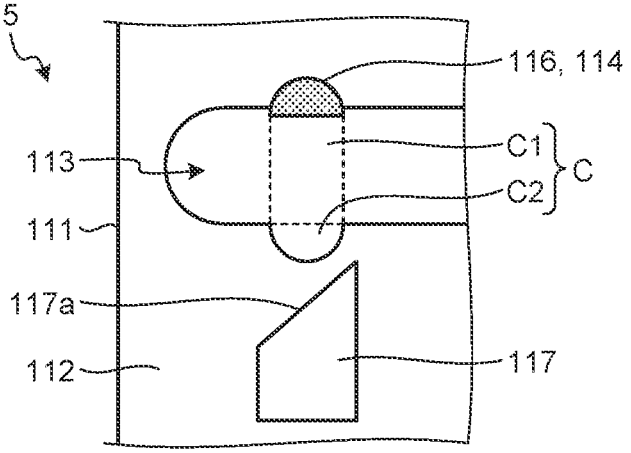
FIG. 11 is a diagram illustrating another variation of the fin reinforcement portion of the heat exchanger fin according to the embodiment.

For example, the fin reinforcement portion 117 of the fin 111 of the heat exchanger 5, may also be formed as per the variations illustrated in FIGS. 10 and 11. FIG. 10 illustrates an example in which the fin reinforcement portion 117 is formed to follow the shape of the cutout portion C2. The mechanical strength of the fin 111 can be improved by providing the fin reinforcement portion 117 around the cutout portion C2 where the mechanical strength is reduced. It is noted that the arc-shaped fin reinforcement portion 117 here is formed along the semicircular cutout portion C2, but as described subsequently, the shape of the fin reinforcement portion 117 may be formed in any desired shape according to the shape of the cutout portion C2.

FIG. 11 illustrates an example in which an opposing surface 117*a* of the fin reinforcement portion 117 facing the cutout portion C2, is formed so as to be inclined in one direction relative to the up-down direction. Condensate readily accumulates in the cutout portion C2, where a gap arises adjacent to the flat tube 11 inserted into the flat tube insertion portion 113. However, when condensate adheres over the cutout portion C2 and the fin reinforcement portion 117, because the opposing surface 117*a* of the fin reinforcement portion 117 is inclined, condensate readily flows along the opposing surface 117*a*, thereby improving the drainage of condensate from the fin 111.

Figure 12:
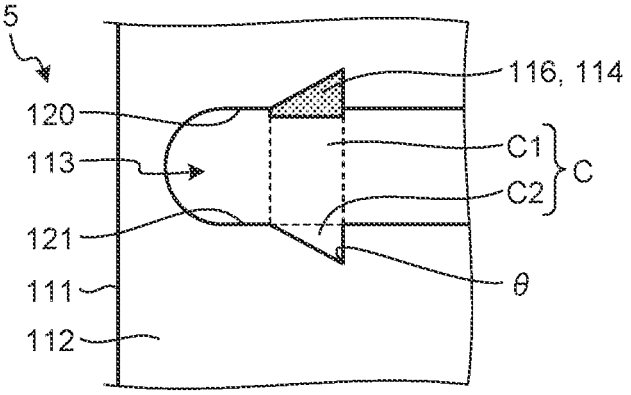
FIG. 12 is a diagram illustrating one variation of the cutout portion of the heat exchanger fin according to the embodiment.
Figure 13:
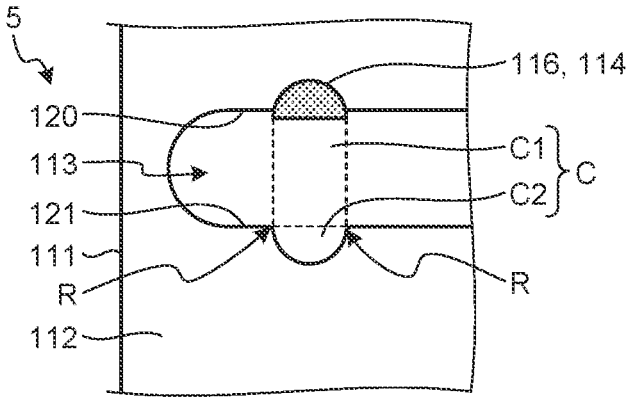
FIG. 13 is a diagram illustrating another variation of the cutout portion of the heat exchanger fin according to the embodiment.

Next, the cutout portion C2 of the fin 111 of the heat exchanger 5 may also be formed as per the variations illustrated in FIGS. 12 and 13. FIG. 12 illustrates an example in which the inner periphery of the cutout portion C2 is cut out so as to have an acute angle portion θ. The acute angle portion θ is formed, for example, by a vertical side along the up-down direction and an inclined side that is inclined relative to the up-down direction. By forming the cutout portion C2 into a shape with the acute angle portion θ, condensate accumulated in the cutout portion C2 concentrates at the acute angle portion θ, thereby facilitating drainage of the condensate from the acute angle portion θ and improving the drainage of condensate from the fin 111. Furthermore, in this example, since the angle between the inclined side of the cutout portion C2 and the second side 121 is smaller, the cutout portion C2 also acts as a guide when inserting the flat tube 11 into the flat tube insertion portion 113, thus improving the assemblability of the heat exchanger 5.

FIG. 13 illustrates an example in which an arc-shaped chamfer (R chamfer) is formed at the boundary between the inner periphery of the cutout portion C2 and the second side 121 of the flat tube insertion portion 113. By not forming a corner at the boundary in this way, the angle between the inner periphery of the cutout portion C2 and the second side 121 becomes smaller, and hence the cutout portion C2 also acts as a guide when inserting the flat tube 11 into the flat tube insertion portion 113, thus improving the assemblability of the heat exchanger 5. Note that a C chamfer may also be formed at the boundary.

REFERENCE SIGNS LIST

1 AIR CONDITIONER
2 INDOOR UNIT
3 OUTDOOR UNIT
4 HEAT EXCHANGER (INDOORS)
5 HEAT EXCHANGER (OUTDOORS)
6 COMPRESSOR
11 FLAT TUBE
111 FIN
111*a* FIRST FIN
111*b* SECOND FIN
112 VENTILATION PORTION (OF FIN)
113 FLAT TUBE INSERTION PORTION (OF FIN)
114 CUT AND RAISED PIECE (OF FIN)
115 RAISED PORTION (OF CUT AND RAISED PIECE)
116 FOLDED PORTION (OF CUT AND RAISED PIECE)
117 FIN REINFORCEMENT PORTION (OF FIN)
117*a* OPPOSING SURFACE OF FIN REINFORCEMENT PORTION FACING CUTOUT PORTION
C AREA OF FIN CONSTITUTING CUT AND RAISED PIECE
C1 CUTOUT REMAINDER PORTION (OF FLAT TUBE INSERTION PORTION)
C2 CUTOUT PORTION (OF VENTILATION PORTION)
W LENGTH OF CUT AND RAISED PIECE (W1+W2)
W1 LENGTH OF C1
W2 LENGTH OF C2
P FIN PITCH
P1 FIN PITCH CORRESPONDING TO C1
P2 ADDITIONAL DISTANCE USING C2
θ ACUTE ANGLE PORTION (OF CUTOUT PORTION)
R R CHAMFER (BOUNDARY BETWEEN INNER PERIPHERY OF CUTOUT PORTION AND SECOND SIDE OF FLAT TUBE INSERTION PORTION)

The invention claimed is:

1. A heat exchanger, comprising:

a plurality of flat tubes that are stacked in a direction perpendicular to a refrigerant flow direction; and a plurality of fins that have a first flat tube insertion portion into which a first flat tube among the plurality of flat tubes is inserted, and a second flat tube insertion portion into which a second flat tube adjacent to the first flat tube is inserted, wherein a first fin among the plurality of fins comprises:

an inner periphery of the first flat tube insertion portion where the first flat tube comes into contact with the first fin;

a cut and raised piece for spacing a fin pitch between the first fin and an adjacent second fin, the cut and raised piece being formed on a first inner periphery located at either side in a thickness direction of the first flat tube in the inner periphery of the first flat tube insertion portion; and a cutout portion obtained by cutting out a second inner periphery in the thickness direction, the cutout portion being formed on the second inner periphery opposing the first inner periphery of the first flat tube insertion portion, wherein the cut and raised piece extends from the first inner periphery to the cutout portion and is formed to include a portion obtained from the cutout portion, and is formed to extend from the first inner periphery to the second fin, thereby having a raised portion of a same length as the fin pitch, and a folded portion that is folded back at a tip of the raised portion and that is in contact with the second fin, and wherein at least one of the raised portion and the folded portion includes a portion matching the cutout portion.

2. The heat exchanger according to claim 1, wherein the first fin is provided, at a position adjacent to the cutout portion between the first flat tube insertion portion and the second flat tube insertion portion, with a fin reinforcement portion that improves a stiffness of the fin.

3. The heat exchanger according to claim 2, wherein the fin reinforcement portion is either a bulging structure, a protruding structure, or a corrugated structure.

4. The heat exchanger according to claim 2, wherein the fin reinforcement portion has one side extending in a direction along the first inner periphery, and is protruding from an entirety of the one side to the second fin, and wherein a length of the one side is greater than a length of the cutout portion with respect to the direction along the first inner periphery.

* * * * *